US006566851B1

(12) United States Patent
Schuelke et al.

(10) Patent No.: US 6,566,851 B1
(45) Date of Patent: May 20, 2003

(54) OUTPUT CONDUCTANCE CORRECTION CIRCUIT FOR HIGH COMPLIANCE SHORT-CHANNEL MOS SWITCHED CURRENT MIRROR

(75) Inventors: Robert John Schuelke, Lakeville, MN (US); Kevin P. Beaudoin, Maple Grove, MN (US)

(73) Assignee: Applied Micro Circuits, Corporation, San Diego, CA (US)

( * ) Notice: Subject to any disclaimer, the term of this patent is extended or adjusted under 35 U.S.C. 154(b) by 127 days.

(21) Appl. No.: 09/636,009

(22) Filed: Aug. 10, 2000

(51) Int. Cl.[7] ..... G05F 3/16

(52) U.S. Cl. ..... 323/315; 323/280

(58) Field of Search ..... 323/312, 313, 323/314, 315, 316, 274, 280, 281

(56) References Cited

U.S. PATENT DOCUMENTS

| | | | | |
|---|---|---|---|---|
| 4,706,013 A | | 11/1987 | Kuo | 323/316 |
| 5,180,966 A | | 1/1993 | Sugawara et al. | 323/308 |
| 5,329,247 A | | 7/1994 | Bayer | 330/288 |
| 5,661,395 A | | 8/1997 | Johnson et al. | 323/273 |
| 5,703,497 A | | 12/1997 | Min | 326/33 |
| 6,066,944 A | * | 5/2000 | Sakurai | 323/315 |

* cited by examiner

*Primary Examiner*—Jessica Han

(57) ABSTRACT

A high-speed current mirror and correction circuitry are provided to minimize current errors in short-channel MOS switched current mirrors. The current mirror supplies high current levels at high modulation speeds, while simultaneously exhibiting good output voltage compliance. The correction circuitry includes a buffer amplifier, current shaping circuit, and replica mirror section. The current shaping circuit is able to supply a differential reference current, to correct load current errors, in response to the replica mirror section matching the buffered load voltage.

21 Claims, 6 Drawing Sheets

OUTPUT CONDUCTANCE CORRECTION CIRCUIT FOR HIGH COMPLIANCE SHORT-CHANNEL MOS SWITCHED CURRENT MIRROR

BACKGROUND OF THE INVENTION

1. Field of the Invention

This invention relates generally to electrical current control circuitry and, more particularly, to a MOS integrated circuit (IC) current mirror correction device that permits a current mirror to be operated at high current levels and rapid switching speeds.

2. Description of the Related Art

As current mirrors comprise a basic and fundamental building block of all electronic systems there consequentially exists a significant amount of prior art. Many conventional current mirror circuits exist that can be switched at high-speeds, but require cascode devices to achieve the current accuracy and, thereby, reduce the compliance voltage. Alternately, they describe sources that are truly DC current mirrors whose output cannot be switched at high speeds.

FIG. 1 depicts a type of current mirror that uses an amplifier to force the drain-to-source voltage across the output transistor to be equal to the voltage across a mirroring transistor (prior art). The amplifier correction device permits the current mirror to achieve accurate output currents. This configuration preserves compliance voltage so long as the gate-to-source voltage is not too large. Such an arrangement, however, does not readily lend itself to modulating the output current at high rates of speed due to the settling time of the amplifier and, as such, is really only applicable to DC or very low-speed current mirrors.

FIG. 2 illustrates a cascode transistor current mirror (prior art). This conventional design can be readily switched at high rates, but the available compliance voltage is reduced due to the use of cascode devices to eliminate output conductance errors.

Despite the significant body of prior art, none of the devices describe a current mirror whose output can be switched at a high rate and that maximizes the available compliance voltage. In order to be able to deliver a modulated current, particularly large currents of several milliamps, which can be switched very quickly, it is necessary that very short gate lengths be used to minimize the size of the device. Minimizing the size of the device is required to minimize its capacitance and, consequently, the switching time. Furthermore, minimizing the channel length also minimizes the saturation voltage and, consequently, maximizes the compliance voltage. Unfortunately, the use of short channel length devices results in a significant error in the output current due to the high output conductance of the short channel device. The typical approach to eliminating the output conductance current error is to force the source-to-drain voltage across the output device to be equal to that across the mirror device by means of either an amplifier or a cascode device. These approaches have disadvantages in terms of switching speed and compliance voltage, as described above.

It would be advantageous if a current mirror circuit could be developed that operated at a high switching speed without cascode transistor arrangements that reduce the compliance voltage.

It would be advantageous if a current mirror circuit could be developed that operated over the full range of compliance voltage without the use of amplifier circuitry with reduces the speed at which current can be modulated.

It would be advantageous if a precision current mirror circuit could be developed that could supply large amounts of current at high speeds.

SUMMARY OF THE INVENTION

Accordingly, a MOS integrated circuit (IC) current mirror circuit is provided comprising a high-speed current mirror section and a correction section. The high-speed current mirror section advantageously does not use a cascode arrangement of output transistors. Primary and differential reference current are amplified at a first current mirror transistor pair and a second current mirror transistor pair has an output to supply the load current. A correction section is connected to the high-speed current mirror section output and, in response, supplies the differential reference current.

The correction section includes a buffer connected to the high-speed current mirror section output. The buffer supplies a buffered version of the load voltage and outputs an error signal. A replica mirror section accepts the buffered load voltage and a replica reference current. The scaled error current is altered by a cooperating current shaping circuit, and a reference current is generated.

Hence, a method for correcting current supplied from a high speed current mirror MOS IC is provided. The method comprises: providing a primary reference current; in a high-speed current mirror section, amplifying the reference current; in response to the amplified reference current, supplying a load current and load voltage at a high-speed current mirror section output; detecting the load voltage; and, supplying a differential reference current with the primary reference current to correct the load current.

In some aspects of the invention, the method further comprises: supplying a scaled replica reference current; amplifying the replica reference current with replica current mirror section; supplying a replica current mirror section output voltage matching the load voltage; and, in response to matching the load voltage, supplying the differential reference current.

DETAILED DESCRIPTION OF THE PREFERRED EMBODIMENTS

Figure 1:
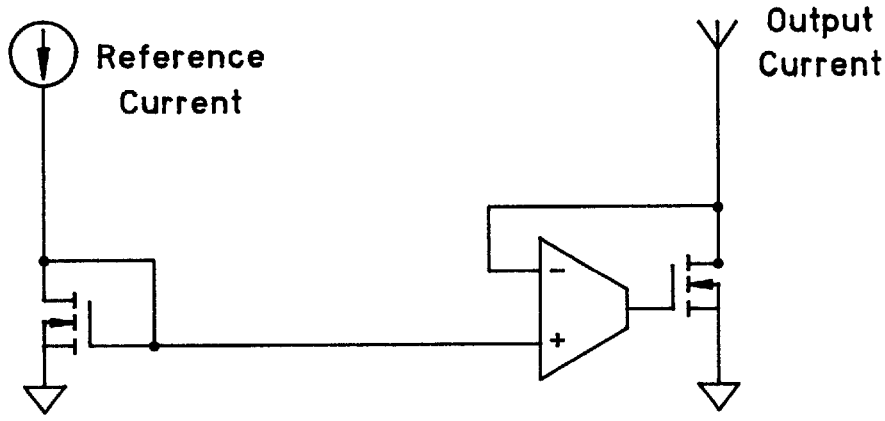
FIG. 1 (PRIOR ART)
FIG. 1 depicts a type of current mirror that uses an amplifier to force the drain-to-source voltage across the output transistor to be equal to the voltage across a mirroring transistor (prior art).
Figure 2:
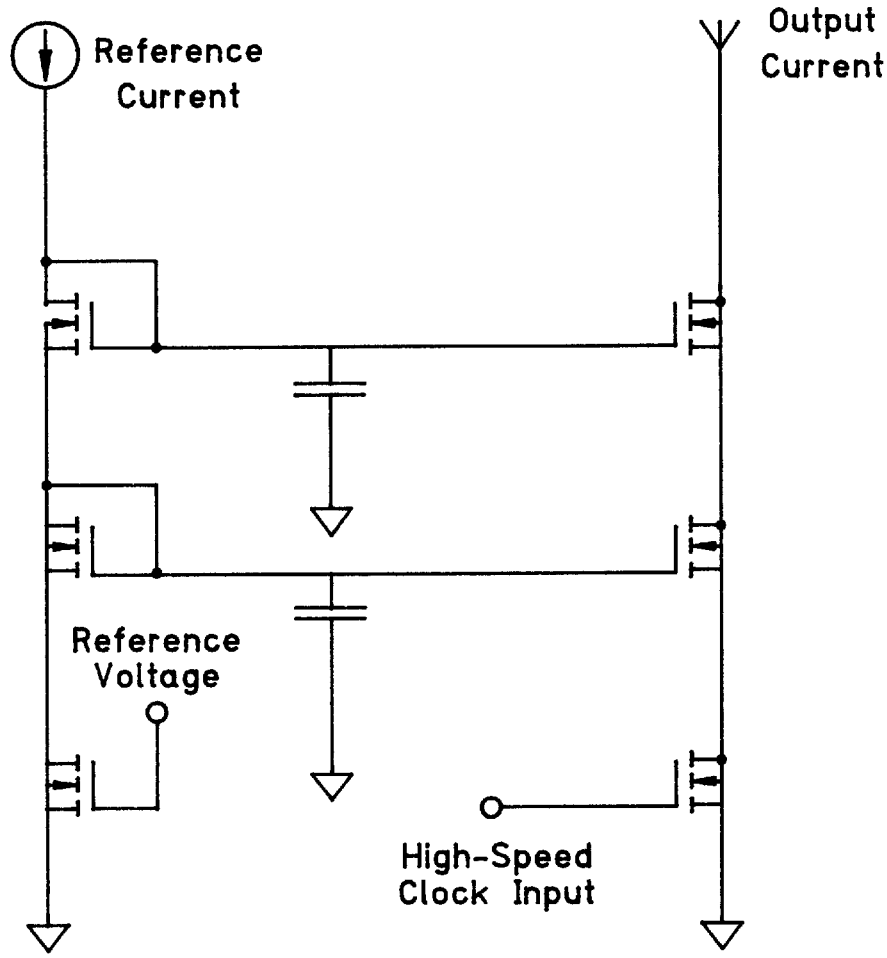
FIG. 2 (PRIOR ART)
FIG. 2 illustrates a cascode transistor current mirror (prior art).
Figure 3:
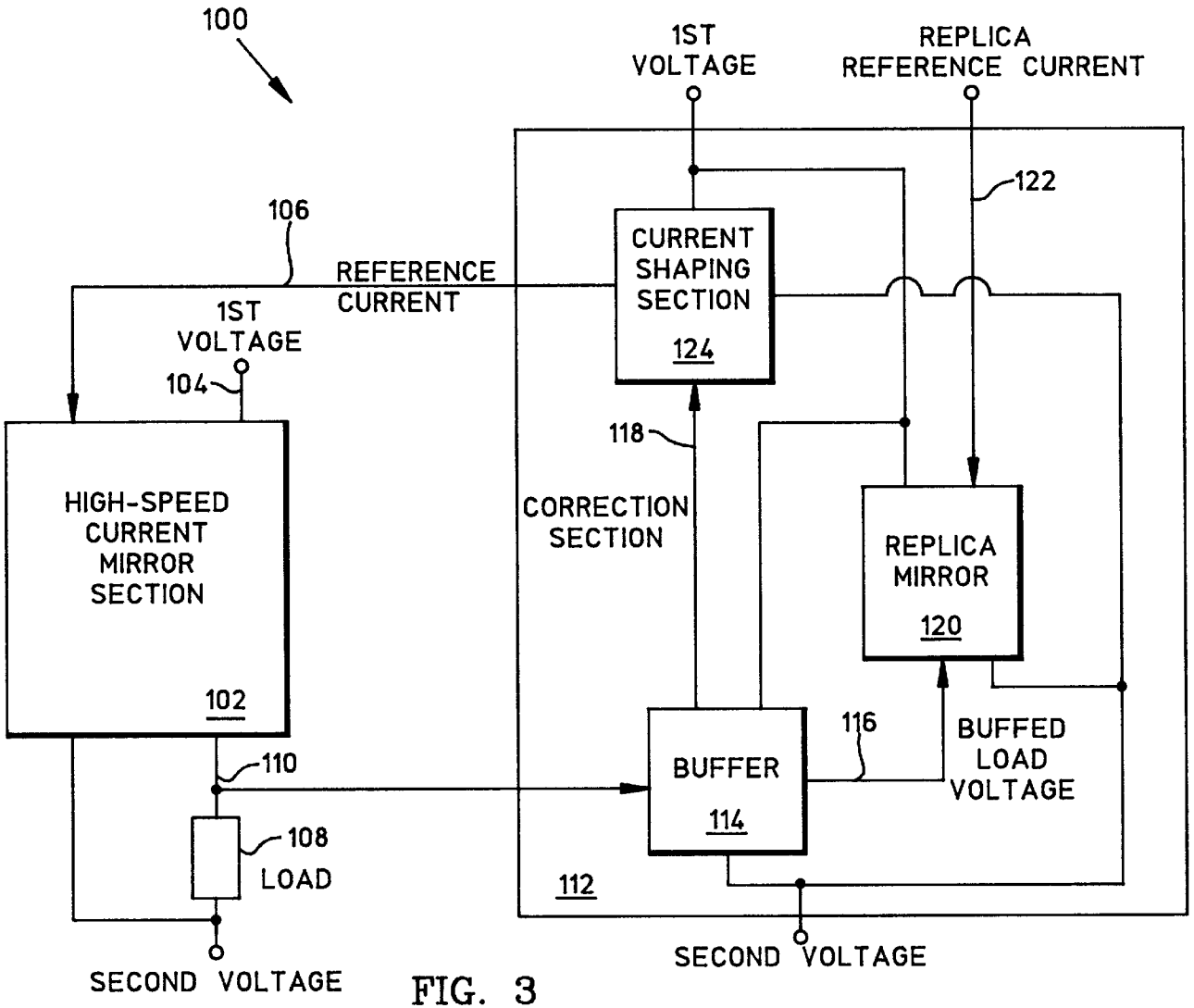
FIG. 3 is a schematic block diagram of a current mirror of the present invention with correction circuitry.

FIG. 3 is a schematic block diagram of a current mirror of the present invention with correction circuitry.

Advantageously, this design can be accommodated in an IC package using MOS devices. This invention corrects for the current magnitude error in a short-channel MOS switched current mirror that results from the high output conductance. The compliance voltage on the current mirror output is maximized, while still allowing the output of the current mirror to be switched at as high a rate.

The invention uses a short gate length current mirror to maximize the compliance voltage and to minimize the switching speed. It then employs a correction circuit to adjust the input current to the high-speed current mirror to compensate for the output current error that results from the short channel length.

The current mirror circuit 100 comprises a high-speed current mirror section 102 having a first input connected to a first voltage source on line 104, a second input to accept reference current on line 106, and a first output connected to a load 108 on line 110. A correction section 112 has an input connected to the high-speed mirror section second output on line 110 and an output connected to the high-speed mirror second input on line 106 to supply reference current.

The correction section 112 includes a buffer 114 having a first input connected to the high-speed mirror second output on line 110, a first output to supply a buffered version of the load voltage on line 116, and a second output to supply a current shaping signal on line 118. A replica mirror section 120 has a first input connected to the buffer first output on line 116 to accept the buffered load voltage and a second input on line 122 to accept a replica reference current. A current shaping section 124 has a first input connected to the buffer second output on line 118 to accept the current shaping signal and a first output connected to the second input of the high-speed mirror on line 106 to supply reference current.

Figure 4:
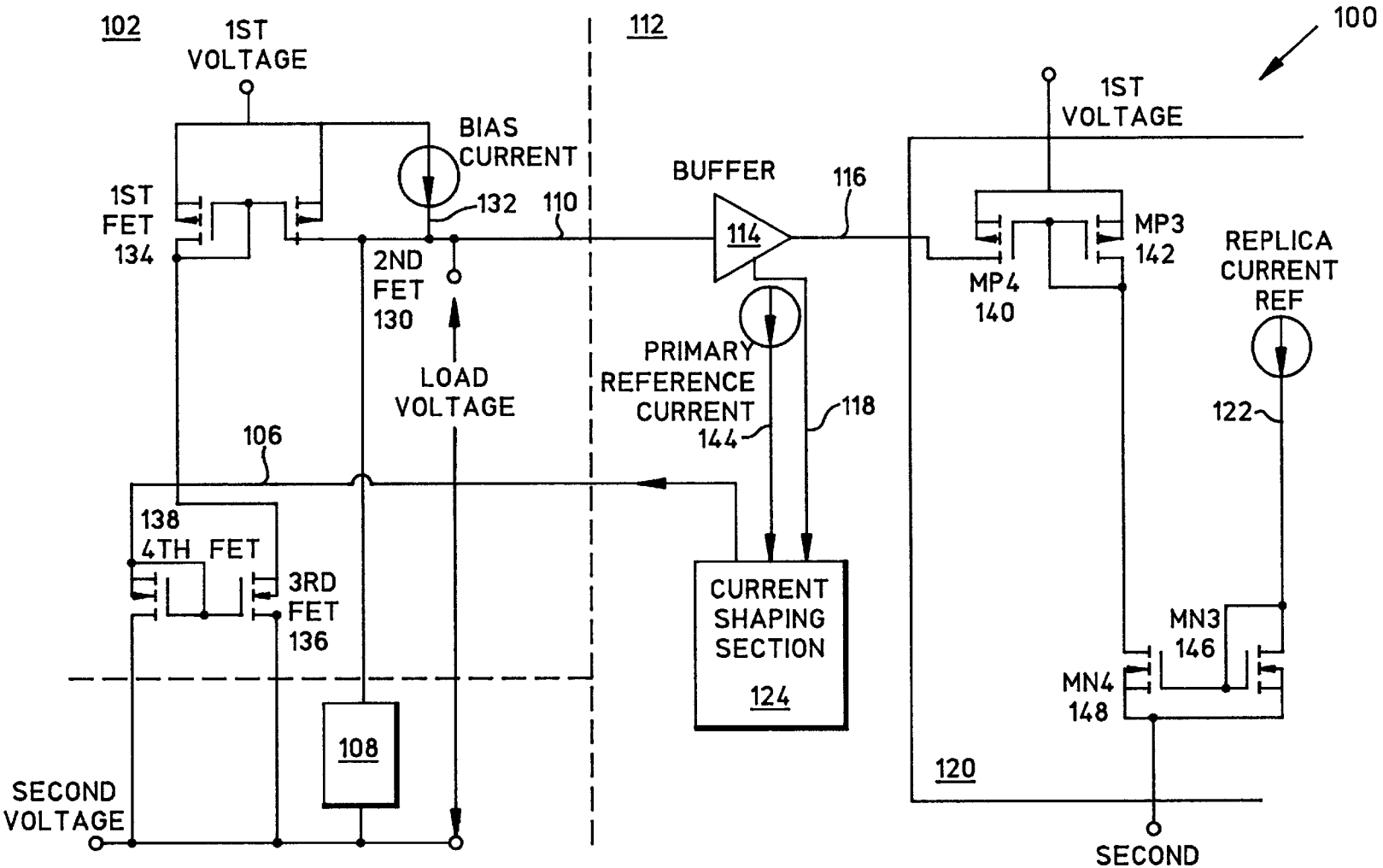
FIG. 4 depicts the invention of FIG. 3 with a non-linear correction section.

FIG. 4 depicts the invention of FIG. 3 with a non-linear correction section 112. In the configuration shown, a modulated output current from second FET 130 is superimposed on a static bias current provided by a separate current mirror path 132. The high-speed switched current mirror is comprised of first FET 134 and second FET 130. While not explicitly shown in FIG. 4, those skilled in the art would be aware of numerous means by which the current output from second FET 130 may be modulated on and off without inserting a switch in series with either the source or drain of the second FET 130. By not using a series switch or a cascode device, the maximum voltage compliance range is obtained on the load 108. The high-speed output mirror 130 is fed by a reference current on line 106 that is gained to the output through the third FET/fourth FET 136/138 current mirror. Both the first FET 134 and the second FET 130 are very short gate length devices that can be modulated at high-speeds. The issue, then, is the loss of the output current accuracy from the second FET 130 resulting from the significant amount of excess current caused by the combination of the high output conductance of the short channel device, and the fact that its source-to-drain voltage does not match that of the first FET 134 mirroring device.

The output current from the second FET 130, $I_2$, in the on-state can be described by the equation $$I_2 = I_1 M_{12} \frac{1+\lambda_2 \cdot V_{DS2}}{1+\lambda_1 \cdot V_{GS1}} \qquad \text{Eq. (1)}$$

where $I_1$ is the current flowing out of the first FET 134, $M_{12}$ is the area ratio of the second FET 130 to the first FET 134, $\lambda_1$ and $\lambda_2$ are the channel length modulation (output conductance) terms (these should be equal for equal gate length devices), $V_{DS2}$ is the drain-to-source voltage across the second FET 130, and $V_{GS1}$ is the gate-to-source (also the source-to-drain voltage by virtue of the diode wire) across the first FET 134. It should be noted that the magnitude of the load current on line 110 is not only a function of the channel length modulation, but also of the voltage across the output and input devices. This relationship implies that the load current on line 110 is then dependent on the first voltage and the impedance of the load 108, as well as the magnitude of the load current on line 110.

The error in the output current can be corrected by modifying the current in the first FET 134 to compensate for the error. The most obvious way to modify $I_1$ is to change its value such that $$I_1 \rightarrow I_1 \frac{1+\lambda_1 \cdot V_{GS1}}{1+\lambda_2 \cdot V_{DS2}}.$$

The resulting output from the second FET 130 would then be the desired current. In order to make this modification a measurement of the error in the load current is required. This is accomplished using the buffer 114, replica circuit 120, and current shaping circuit 124. The replica circuit 120 is a scaled version of the high-speed current mirror section 102 that is connected to the load 108. The buffer circuit 114 forces the voltage across the output of the replica circuit 120 (i.e., the $V_{DS}$ of MP4 140) to be equal or nearly equal (e.g., equal to the average value) to the voltage across the load 108. A scaled current (reference current) that is proportional to the load current from the second FET 130, $I_{REFSC}$, in the absence of the correction is then generated. This scaled current can be described by $$I_{REFSC} = I_{MP3} M_{34} \frac{1+\lambda_{MP4} \cdot V_{DSMP4}}{1+\lambda_{MP3} \cdot V_{GSMP3}} \qquad \text{Eq. (2)}$$

where $I_{MP3}$ is the current flowing out of MP3 142, $M_{34}$ is the area ratio of MP4 140 to MP3 142, $\lambda_{MP3}$ and $\lambda_{MP4}$ are the channel length modulation (output conductance) terms (these should be equal for equal gate length devices), $V_{DSMP4}$ is the drain-to-source voltage across MP4 140, and $V_{GSMP3}$ is the gate-to-source (also the source-to-drain voltage by virtue of the diode wire) across MP3 142. The scaled current is then combined with the primary reference current, $I_{REF}$, on line 144 to modify the input reference current to the fourth FET 138. This can be accomplished by implementing a current multiplier circuit in the current shaping circuit 124 to form the quotient $I_{REF}^2/BI_{REFSC}$ where B is a scaling factor.

This approach, however, requires nonlinear processing of the error current to transform the primary reference current on line 144 into the modified reference current on line 106 for the fourth FET 138. For strictly MOS designs the implementation of current multiplier/dividers at non-subthreshold current levels, while not impossible, is a complex and not always an economical task. BiCMOS and weak inversion MOS implementations would more readily lend themselves to this approach, as the bipolar components would facilitate the implementation of the required multiplier/divider.

Another approach, more readily implemented in straight MOS circuitry, is an approximate linear correction. Consider the modification of $I_1$ such that its value becomes $I_1 \rightarrow I_1(1-$ A). Inserting this into the equation above results in the expression $$I_2 = I_1 M_{12} \frac{(1-A)(1+\lambda_2 \cdot V_{DS2})}{1+\lambda_1 \ V_{GS1}} \quad \text{Eq. (3)}$$

The desired output current is exactly realized if the equality of Equation 4 is observed.

$$A = \frac{(\lambda_2 \cdot V_{DS2}) - (\lambda_1 \cdot VGS1)}{1+\lambda_2 \cdot V_{DS2}} \quad \text{Eq. (4)}$$

However, realizing this exact solution also posses challenges to a strictly MOS implementation. Alternately, a reasonable approximation to the desired current can be developed if the replica circuit shown is used to develop an error signal that is subtracted from the primary reference current.

Figure 5:
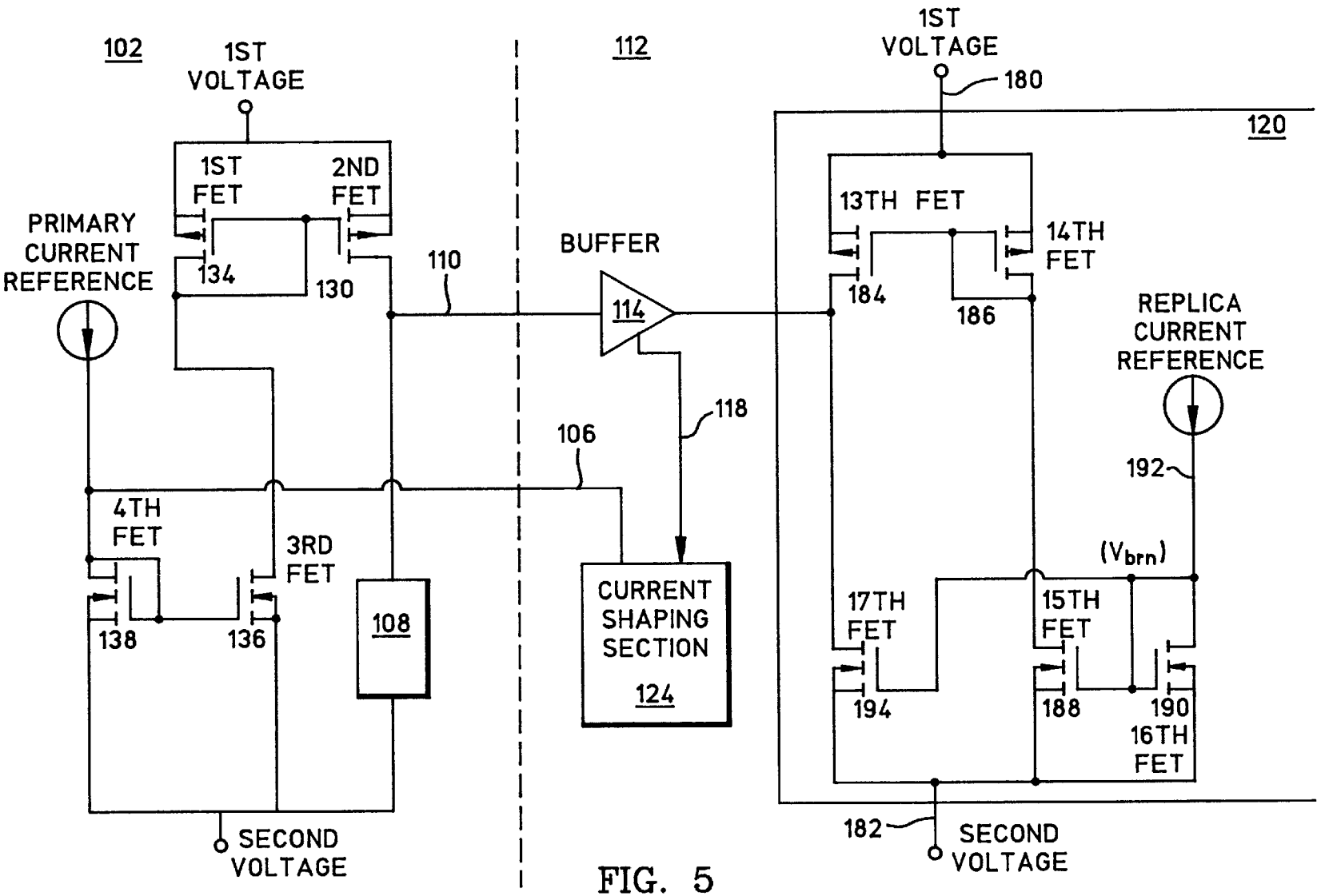
FIG. 5 is a schematic block diagram of a current mirror with linear approximation correction circuitry.

FIG. 5 is a schematic block diagram of a current mirror with linear approximation correction circuitry. Before discussing the replica mirror 120 in detail, the buffer 114 and current shaping circuits 124 are presented.

Figure 6:
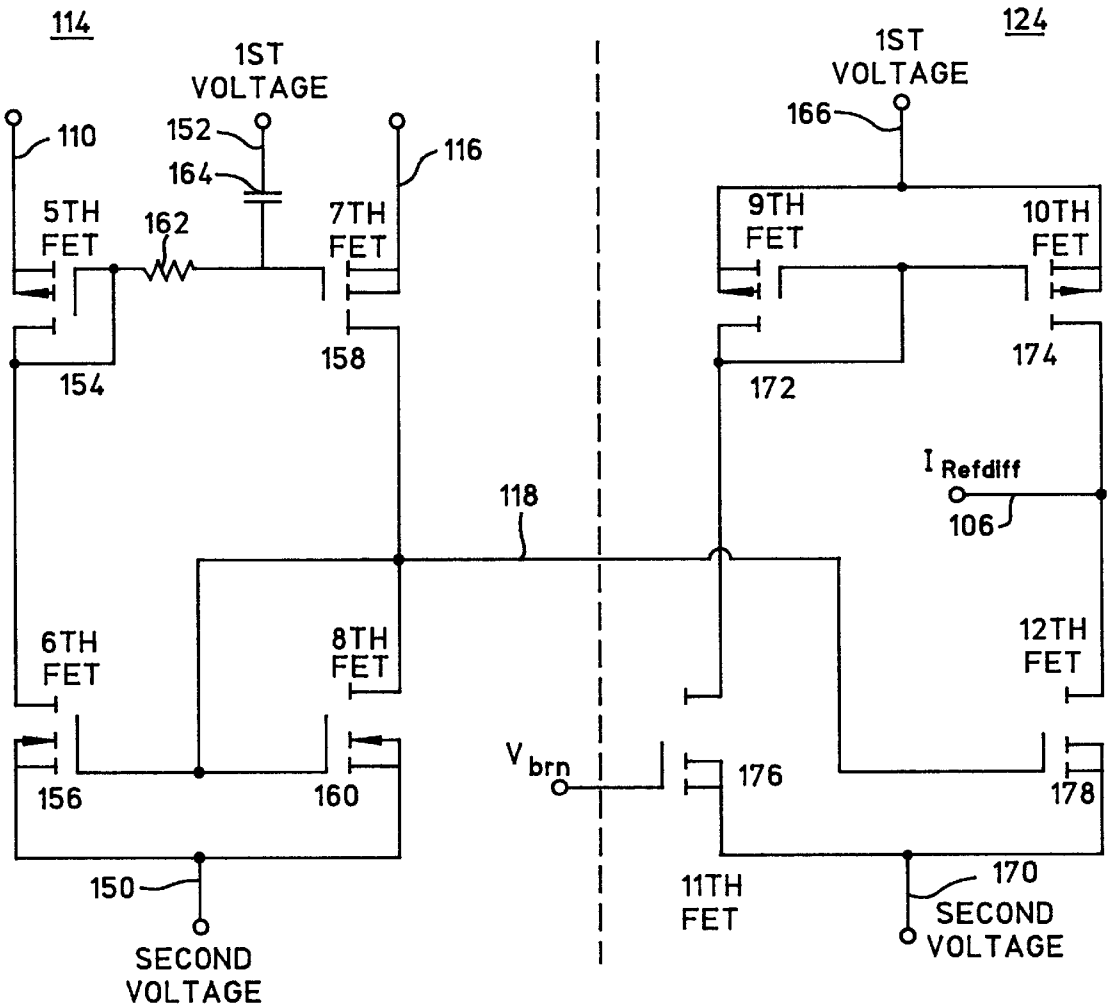
FIG. 6 is a schematic block diagram of the buffer and current shaping circuits of FIG. 5.

FIG. 6 is a schematic block diagram of the buffer 114 and current shaping circuits 124 of FIG. 5. As known to those skilled in the art, there are several means by which the above buffer amplifiers can be implemented. One preferred embodiment of the buffer amplifier 114 is shown. The buffer 114 has a second output connected to the second voltage source on line 150. The first input is accepted on line 110, and a third input is connected to the first voltage on line 152. The buffer circuit 124 further includes a fifth FET 154 having a source connected to the first input on line 110 to accept the load voltage. A sixth FET 156 has a drain connected to the drain and gate of the fifth FET 154 and a source connected to the second voltage source on line 150. A seventh FET 158 has a source to supply the buffered load voltage at the first output on line 116 and a gate connected to the gate of the fifth FET 154. An eighth FET 160 has a source connected to the second voltage source on line 150. The drain of the eighth FET 160 is connected to the drain of the seventh FET 158, to its own gate, and to the second output to supply the current shaping signal on line 118. In some aspects of the invention a resistor 162 is placed in series from the gate of fifth FET 154 to the first voltage source on line 152 and the gate of seventh FET 158. A capacitor 164 is placed in shunt between the resistor 162 and the gate of seventh FET 158. As shown, the capacitor 164 is in the first voltage line 152.

In FIG. 6, the p-channel input devices, fifth FET 154 and seventh FET 158, are used to allow the buffer to operate as close to the first voltage as possible. This is commensurate with the design objective of allowing the circuit 100 to maintain as great a compliance voltage as possible. An n-channel current mirror, sixth FET 156 and eight FET 160, supplies proportional bias current to both halves of the circuit. A start-up circuit (not shown) is required to ensure proper operation of the buffer. The bias currents must be significantly less than the output current from the high-speed current mirror 102 such that the buffer 114 does not introduce an error of its own. The bias current and the current shaping current are one in the same. This current is an error current that is proportional to the error in the load current in line 110, and can be extracted from buffer 114 by adding a mirror output to the n-channel current mirror, as shown in the current shaping section 124 with twelfth FET 178. The RC circuit (resistor 162 and capacitor 164) acts to force an average of the load voltage to the output of the buffer 114 on line 116 and to ensure the stability of the circuit.

To minimize the magnitude of the bias current through fifth FET 154, the device W/L ratio is kept as small as possible. The area ratio of seventh FET 158 to fifth FET 154 is then adjusted to supply the necessary amount of current compensation due to losses from increasing output conduction of the high-speed current mirror section 102.

The current shaping section 124 includes a second input connected to the first voltage source on line 166, a third input connected to Vbnr on line 168, and a second output connected to the second voltage source on line 170. The current shaping section 124 further includes a third current mirror transistor pair including a ninth FET 172 and tenth FET 174 having sources connected to the first voltage source on line 166. An eleventh FET 176 and twelfth FET 178 have sources connected to the second voltage source on line 170. The eleventh FET 176 has a drain connected to the drain and gate of the ninth FET 172 and the gate of the tenth FET 174. The gate of eleventh FET 176 is connected to the third input to accept the Vbrn (see FIG. 5). The twelfth FET 178 has a gate connected to accept the current shaping signal on line 118 and a drain connected to the drain of the tenth FET 174 to supply the differential reference current on line 106.

Returning to FIG. 5, the replica mirror section 120 includes a third input connected to the first voltage source on line 180 and a first output connected to the second voltage source on line 182. The replica mirror section 120 includes a fourth current mirror transistor pair having a thirteenth FET 184 and fourteenth FET 186 with the thirteenth and fourteenth FET sources connected to the first voltage source on line 180 and the thirteenth FET 184 drain connected to accept the buffered load voltage on line 116.

A fifth current mirror transistor pair has a fifteenth FET 188 and sixteenth FET 190, with the fifteenth and sixteenth FET sources connected to the second voltage source on line 182. The fifteenth FET 188 has a drain connected to the drain of the fourteenth FET 186. The sixteenth FET 190 has a drain connected to the second input to accept the replica reference current on line 192, and to supply Vbrn, see FIG. 6.

One difference between the replica circuits of FIGS. 4 and 5 is that the error current generated from the replica circuit of FIG. 5 is compared against the expected current level by the introduction of current source seventeenth FET 194. The seventeenth FET 194 has a drain connected to the drain of the thirteenth FET 184, a source connected to the second voltage source on line 182, and a gate connected to gate of the fifteenth FET 188 and the gate and drain of the sixteenth FET 190. The buffer circuit 114 then extracts the differential error current, $I_{REFDIFF}$, $$I_{REFDIFF} = I_{14} M_{14/13} \left( \frac{1+\lambda_{13} \cdot V_{DS13}}{1+\lambda_{14} \cdot V_{GS14}} - 1 \right) \quad \text{Eq. (5)}$$

where $I_{14}$ is the current flowing out of the fourteenth FET. $M_{14/13}$ is the area ratio of the fourteenth FET to the thirteenth FET. $\lambda_{14}$ is the channel length modulation term for the fourteenth FET and $\lambda_{13}$ is the channel length modulation term for the thirteenth FET. $V_{DS13}$ is the drain-to-source voltage for the thirteenth FET and $V_{GS14}$ is the gate-to-source voltage for the fourteenth FET.

A scaled version of this current is then subtracted from the primary reference. As would be known to those skilled in the art, there are actually several different circuit nodes at which the error correction can be introduced into the reference current. The voltage forced across thirteenth FET 184 does not necessarily have to be equal to the voltage across second FET 130, nor does the replica circuit 120 have to be a direct linear scaling.

The high-speed current mirror output can then be expressed as $$I_2 = (I_{REF} - I_{REFDIFF})M_{34}M_{12}\frac{1+\lambda_2 \cdot V_{DS2}}{1+\lambda_1 \cdot V_{GS1}} \quad \text{Eq. (6)}$$

where $I_2$ is the current flowing out of the second FET, $I_{REF}$ is the primary reference current, $M_{34}$ is the area ratio of the third FET to the fourth FET, and $M_{12}$ is the area ratio of the first FET to the second FET. $\lambda_2$ is the channel length modulation term for the second FET, $\lambda_1$ is the channel length modulation term for the first FET, $V_{DS2}$ is the drain-to-source voltage for the second FET, and $V_{GS1}$ is the gate-to-source voltage for the first FET.

By defining C as the ratio of $I_{14}$ to $I_{REF}$ we can rewrite Eq. 6 as $$I_2 = I_{REF}\ M_{21}M_{34}\left(1 - C\ M\frac{14}{13}\left(\frac{1+\lambda_{13}\cdot V_{DS13}}{1+\lambda_{14}\cdot V_{GS14}} - 1\right)\right)\frac{1+\lambda_2 \cdot V_{DS2}}{1+\lambda_1 \cdot V_{GS1}} \quad \text{Eq. (7a)}$$

$$= I_{REF}\ M_{21}M_{34}\frac{\left(1+\lambda_{14}\cdot V_{GS14}\left(1+CM\frac{14}{13}\right) - C\ M\frac{14}{13}\lambda_{M13}\cdot V_{DS13}\right)(1+\lambda_2 \cdot V_{DS2})}{(1+\lambda_{14}\cdot V_{GS14})(1+\lambda_1 \cdot V_{GS1})} \quad \text{Eq. (7b)}$$

From this expression we can see that there are a number of terms and ratios that can be manipulated in the design to minimize the output current sensitivity to the output conductance, the supply voltage, the output current magnitude, and the load.

The invention also tracks with temperature since thirteenth FET 172 is subjected to the same compliance voltage as second FET 130. As the temperature increases, the error current that is diverted from the load 108 into fifth FET 154 (see FIG. 6) decreases, which in turn causes the primary reference current to increase, thus maintaining a compensated reference current.

The primary reference current is a well defined current generated by a central current reference circuit (not shown). The replica reference current is also well defined, in a fixed proportional relationship to the primary reference current. Typically, the primary and replica reference currents remain constant as the load current is modulated. In some aspects of the invention the primary reference current changes as the load current is modulated, but the replica current remains in the same proportional relationship to the primary reference current.

Figure 7:
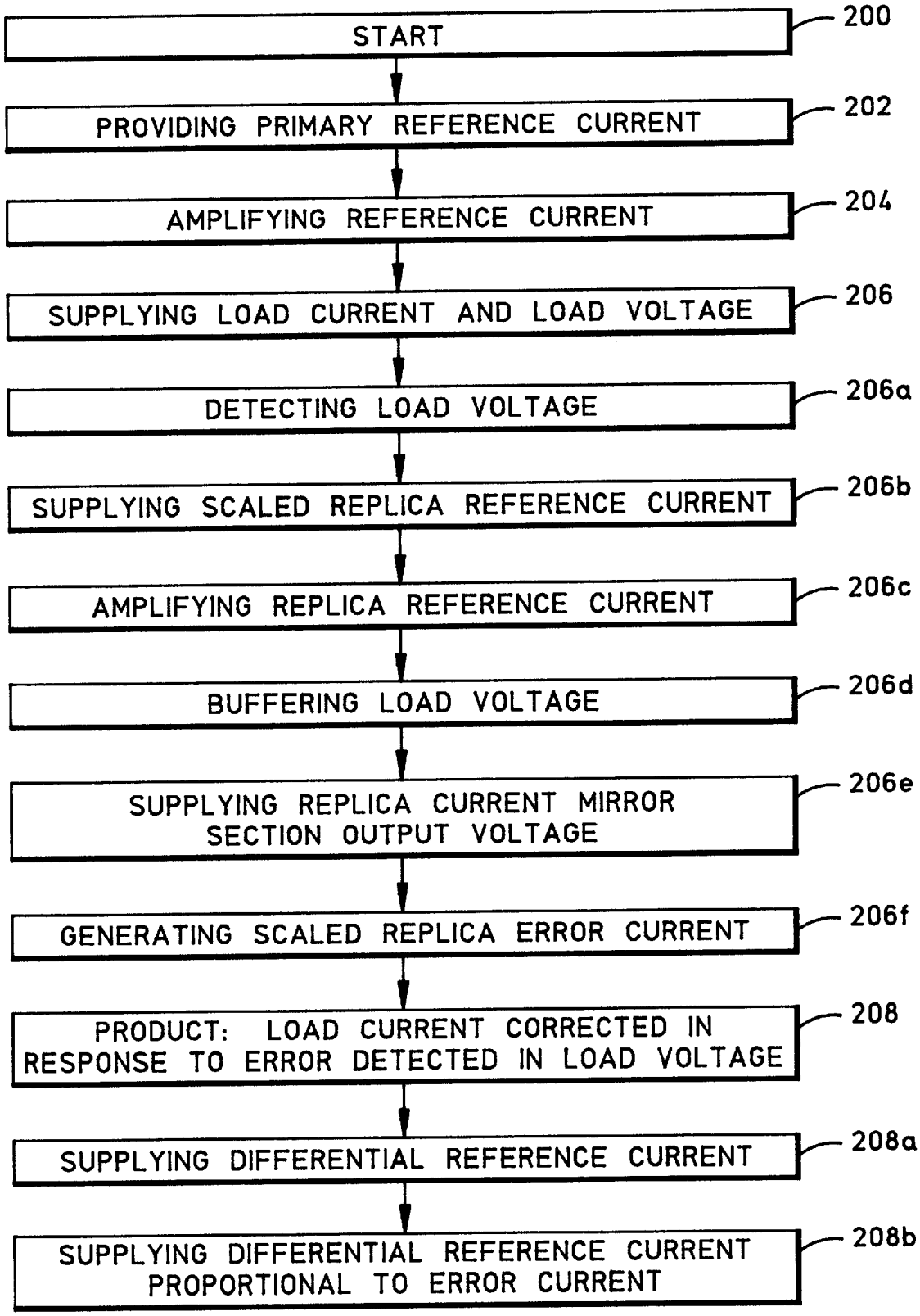
FIG. 7 is a flowchart illustrating a method for correcting current supplied from a high speed current mirror in a MOS IC.

FIG. 7 is a flowchart illustrating a method for correcting current supplied from a high speed current mirror in a MOS IC. Although the process is depicted as a sequence of sequential steps for clarity, no order should be inferred from the numbering unless specifically stated. Step 200 is the start. Step 202 provides a primary reference current. Step 204, in a high-speed current mirror section, amplifies the reference current. Step 206, in response to the amplified reference current, supplies a load current and load voltage at a high-speed current mirror section output. Step 208 is a product, where the load current is corrected in response to errors detected in the load voltage.

Some aspects of the invention include further steps. Step 206*a* detects the load voltage. Then, Step 208*a* supplies a differential reference current, with the primary reference current, to correct the load current. In some aspects of the invention, supplying the differential reference current in Step 208*a* includes supplying a differential reference current that is proportional to the load current.

Some aspects of the invention include further steps. Step 206*b* supplies a scaled replica reference current. That is, a reference current which is scaled to the primary reference current. Step 206*c* amplifies the replica reference current with replica current mirror section that, once again, is scaled to the high-speed mirror section. Step 206*d* buffers the load voltage. Step 206*e* supplies a replica current mirror section output voltage matching the load voltage. That is, the replica current mirror section output voltage is matched to the buffered output voltage. Then, in response to matching the load voltage, Step 206*f* generates a scaled replica error current. Some aspects of the invention include a further step. Step 208*b* supplies a differential reference current that is proportional to the scaled replica error current of Step 206*f*.

Supplying a load current at a high-speed current mirror section output in Step 206 includes the high-speed current mirror section be comprised of the elements shown in FIG. 5 and as described above. Likewise, buffering the load voltage in Step 206*d* includes a buffer circuit as described in the explanation of FIG. 6. Supplying a replica current mirror section output voltage matching the buffered load voltage in Step 206*e* includes using the replica mirror section described above in FIG. 5. Supplying a differential reference current in Step 208*b* that is proportional to the scaled replica error current includes using a current shaping circuit as explained above in the description of FIG. 6.

Likewise, supplying the differential reference current in Step 208 includes supplying the differential reference current as described above in Equation 5, above. Supplying the load current in Step 206 includes supplying the load current as described above in Equation 6, above.

An improved current mirror circuit has been provided that can be modulated at high-speeds, with a maximally compliant voltage range and good output current accuracy. Specific circuitry was presented to exemplify the concepts of the present invention. However, the present invention is not necessarily limited to the particular parts and arrangement of parts depicted in the drawings and described above, as alternate circuit configurations could be made to perform the same functions. Alternate embodiments and variations will therefore occur to those skilled in the art.

We claim:

1. In a MOS integrated circuit, a current mirror circuit comprising:

a high-speed current mirror section having a first connection for a first voltage source, a second connection for a second voltage source, an input to accept a reference current, and an output for supplying a load current and a load voltage to a load connected to the second voltage source; and a correction section having an input connected to the high-speed mirror section output to receive the load voltage and an output connected to the high-speed mirror input to supply the reference current;

wherein the high-speed current mirror section includes:

a first current mirror transistor pair having a first field effect transistor (FET) and a second FET with the first and second FET sources connected to the first voltage source and the second FET drain connected to the high-speed mirror section output to supply the load current and load voltage; and a second current mirror transistor pair having a third and fourth FET with the third and fourth FET sources connected to the second voltage source, the third FET having a drain connected to the drain of the first FET, and the fourth FET drain connected to accept the reference current.

2. The circuit of claim 1 wherein the first current mirror transistor pair includes the gate of the first FET being connected to the gate of the second FET and gate of the first FET being connected to the drain of the first FET; and wherein the second current mirror transistor pair includes the gate of the third FET being connected to the gate of the fourth FET and the gate of the third FET being connected to drain of the third FET.

3. The circuit of claim 1 in which the reference current includes a primary reference current and a differential reference current, and wherein the correction section includes:

a replica mirror section having an input connected to accept a buffered load voltage, an input to accept a replica reference current, and an output to supply an error current; and in which the correction section supplies a differential reference current that is proportional to the error current at the replica mirror section output.

4. The circuit of claim 3 in which the correction section further includes:

a buffer having an input connected to the high-speed mirror section output to accept the load voltage, an output connected to the replica mirror section to supply the buffered load voltage, and an output to supply a current shaping signal; and a current shaping section having an input connected to the buffer to accept the current shaping signal and an output connected to the high-speed current mirror section to supply the differential reference current.

5. The circuit of claim 4 wherein the buffer has an output connected to the second voltage source, and wherein the buffer circuit includes:

a fifth FET having a source connected to accept the load current;

a sixth FET having drain connected to the drain and gate of the fifth FET and a source connected to the second voltage source;

a seventh FET having a source to supply the buffered load voltage and a gate connected to the gate of the fifth FET; and an eighth FET having a drain connected to the drain of the seventh FET, a source connected to the second voltage source, and a gate connected to supply the current shaping signal.

6. The circuit of claim 5 wherein the current shaping section includes an input connected to the first voltage'source, an input connected to Vbnr, and an output connected to the second voltage source, and wherein the current shaping section further includes:

a third current mirror transistor pair including ninth and tenth FETs having sources connected to the first voltage source, eleventh and twelfth FETs having sources connected to the second voltage source, the eleventh FET having a drain connected to the drain and gate of the ninth FET and the gate of the tenth FET, the eleventh FET has a gate connected to the third input to accept the Vbrn, and the twelfth FET having a gate connected to accept the current shaping signal and a drain connected to the drain of the tenth FET to supply the differential reference current.

7. The circuit of claim 6 wherein the replica mirror section includes an input connected to the first voltage source and an output connected to the second voltage source, and wherein the replica mirror section includes:

a fourth current mirror transistor pair having thirteenth and fourteenth FETs with the thirteenth and fourteenth FET sources connected to the first voltage source and the thirteenth FET drain connected to accept the buffered load voltage;

a fifth current mirror transistor pair having an fifteenth and sixteenth FETs with the fifteenth and sixteenth FET sources connected to the second voltage source, the fifteenth FET having a drain connected to the drain of the fourteenth FET, and the sixteenth FET drain connected to accept the replica reference current and to supply Vbrn; and a seventeenth FET having a drain connected to the drain of the thirteenth FET, a source connected to the second voltage source, and a gate connected to gate of the fifteenth FET and the gate and drain of the sixteenth FET.

8. The circuit of claim 7 wherein current shaping section output supplies differential reference current as follows:

$$I_{REFDIFF} = I_{14} M_{14/13}\left(\frac{1+\lambda_{13}\cdot V_{DS13}}{1+\lambda_{14}\cdot V_{GS14}} - 1\right)$$

where $I_{14}$ is the current flowing out of the fourteenth FET;

$M_{14/13}$ is the area ratio of the fourteenth FET to the thirteenth FET;

$\lambda_{14}$ is the channel length modulation term for the fourteenth FET;

$\lambda_{13}$ is the channel length modulation term for the thirteenth FET;

$V_{DS13}$ is the drain-to-source voltage for the thirteenth FET; and $V_{GS14}$ is the gate-to-source voltage for the fourteenth FET.

9. The circuit of claim 8 wherein the high-speed current mirror section supplies load current as follows:

$$I_2 = (I_{REF} - I_{REFDIFF}) M_{34} M_{12} \frac{1+\lambda_2\cdot VDS2}{1+\lambda_1\cdot VGS1}$$

where $I_2$ is the current flowing out of the second FET;

$I_{REF}$ is the primary reference current;

$M_{34}$ is the area ratio of the third FET to the fourth FET;

$M_{12}$ is the area ratio of the first FET to the second FET;

$\lambda_2$ is the channel length modulation term for the second FET;

$\lambda_1$ is the channel length modulation term for the first FET;

$V_{DS2}$ is the drain-to-source voltage for the second FET; and $V_{GS1}$ is the gate-to-source voltage for the first FET.

10. The circuit of claim 5 wherein the buffer further includes a resistor connected between the gates of the fifth and seventh FETs and a capacitor, in shunt, from the gate of the seventh FET.

11. In a MOS integrated circuit, a method for correcting current supplied from a high speed current mirror, the method comprising:

providing a primary reference current;

in a high-speed current mirror section, amplifying the reference current;

in response to the amplified reference current, supplying a load current and load voltage at a high-speed current mirror section output;

detecting errors in the load voltage; and correcting the load current in response to errors detected in the load voltage by supplying a differential reference current, with the primary reference current, to correct the load current.

12. The method of claim 11 wherein supplying the differential reference current includes supplying a differential reference current to is proportional to the load current.

13. The method of claim 11 further comprising:

supplying a replica reference current scaled to the primary reference current;

amplifying the replica reference current with a replica current mirror section;

supplying a replica current mirror section output voltage matching the load voltage;

in response to matching the load voltage, generating a scaled replica error current.

14. The method of claim 13 further comprising:

supplying the differential reference current that is proportional to the scaled replica error current.

15. The method of claim 14 further comprising:

buffering the load voltage; and wherein supplying a replica current mirror section output voltage includes matching the replica output voltage to the buffered load voltage.

16. The method of claim 15 wherein supplying a load current at a high-speed current mirror section output includes the high-speed current mirror section comprising:

a first current mirror transistor pair having a first and second FET with the first and second FET sources connected to a first voltage source and the second FET drain to supply the load current; and a second current mirror transistor pair having a third and fourth FET with the third and fourth FET sources connected to a second voltage source, the third FET having a drain connected to the drain of the first FET, and the fourth FET drain connected to accept primary and differential reference current.

17. The method of claim 16 wherein buffering the load voltage includes a buffer circuit comprising:

a fifth FET having a source to accept the load voltage;

a sixth FET having drain connected to the drain and gate of the fifth FET and a source connected to the second voltage source;

a seventh FET having a source to supply the buffered load voltage and a gate connected to the gate of the fifth FET; and an eighth FET having a drain connected to the drain of the seventh FET, a source connected to the second voltage source, and a gate to supply the current shaping signal.

18. The method of claim 17 further comprising:

accepting a Vbrn signal; and wherein shaping the differential reference current includes a current shaping circuit comprising:

a third current mirror transistor pair including ninth and tenth FETs having sources connected to the first voltage source, eleventh and twelfth FETs having sources connected to the second voltage source, the eleventh FET having a drain connected to the drain and gate of the ninth FET and the gate of the tenth FET, the twelfth FET having a gate connected to accept the current shaping signal and a drain connected to the drain of the tenth FET to supply the differential reference current.

19. The method of claim 18 wherein supplying a replica current mirror section output voltage matching the buffered load voltage includes the replica mirror section comprising:

a fourth current mirror transistor pair having thirteenth and fourteenth FETs with the thirteenth and fourteenth FET sources connected to the first voltage source and the thirteenth FET drain connected to accept the buffered load voltage;

a fifth current mirror transistor pair having an fifteenth and sixteenth FETs with the fifteenth and sixteenth FET sources connected to the second voltage source, the fifteenth FET having a drain connected to the drain of the fourteenth FET, and the sixteenth FET drain connected to the second input to accept the replica reference current and to supply Vbrn; and a seventeenth FET having a drain connected to the drain of the thirteenth FET, a source connected to the second voltage source, and a gate connected to gate of the fifteenth FET and the gate and drain of the sixteenth FET.

20. The method of claim 19 wherein supplying the differential reference current includes supplying the differential reference current as follows:

$$I_{REDIFF} = I_{14} M_{14/13}\left(\frac{1+\lambda_{13}\cdot V_{DS13}}{1+\lambda_{14}\cdot V_{GS14}} - 1\right)$$

where $I_{14}$ is the current flowing out of the fourteenth FET;

$M_{14/13}$ is the area ratio of the fourteenth FET to the thirteenth FET;

$\lambda_{14}$ is the channel length modulation term for the fourteenth FET;

$\lambda_{13}$ is the channel length modulation term for the thirteenth FET;

$V_{DS13}$ is the drain-to-source voltage for the thirteenth FET; and $V_{GS14}$ is the gate-to-source voltage for the fourteenth FET.

21. The method of claim 20 wherein supplying the load current includes supplying the load current as follows:

$$I_2 = (I_{REF} - I_{REFDIFF}) M_{34} M_{12} \frac{1+\lambda_2\cdot V_{DS2}}{1+\lambda_1\cdot V_{GS1}}$$

where $I_2$ is the current flowing out of the second FET;

$I_{REF}$ is the primary reference current;

$M_{34}$ is the area ratio of the third FET to the fourth FET;

$M_{12}$ is the area ratio of the first FET to the second FET;

$\lambda_2$ is the channel length modulation term for the second FET;

$\lambda_1$ is the channel length modulation term for the first FET;

$V_{DS2}$ is the drain-to-source voltage for the second FET; and $V_{GS1}$ is the gate-to-source voltage for the first FET.

* * * * *